US006679590B2

(12) United States Patent
Enz

(10) Patent No.: US 6,679,590 B2
(45) Date of Patent: Jan. 20, 2004

(54) SHUTDOWN FOR AN INK JET PRINTER

(75) Inventor: Richard T. Enz, Dayton, OH (US)

(73) Assignee: Scitex Digital Printing, Inc., Dayton, OH (US)

( * ) Notice: Subject to any disclaimer, the term of this patent is extended or adjusted under 35 U.S.C. 154(b) by 186 days.

(21) Appl. No.: 10/003,794

(22) Filed: Oct. 31, 2001

(65) Prior Publication Data

US 2003/0081046 A1 May 1, 2003

(51) Int. Cl.[7] ..... B41J 2/02

(52) U.S. Cl. ..... 347/73

(58) Field of Search ..... 347/73, 28, 78, 347/75, 20, 74, 14

(56) References Cited

U.S. PATENT DOCUMENTS 5,786,829 A * 7/1998 Pasciak et al. ..... 347/28
6,350,021 B1 * 2/2002 Gray et al. ..... 347/78

* cited by examiner

*Primary Examiner*—Lamson Nguyen
*Assistant Examiner*—K. Feggins
(74) *Attorney, Agent, or Firm*—Barbara Joan Haushalter

(57) ABSTRACT

A system and method are provided for improving the reliability for shutting down high resolution ink jet printheads for continuous ink jet printers. The shutdown technique fo the present invention solves the problem of ink and/or flush fluid drying in or around orifice holes on higher resolution printheads. This is accomplished with pulse modulation of air pressure used to blow and dry the printhead filters while balancing air flow and negative pressure across the droplet generator and the orifice array.

18 Claims, 3 Drawing Sheets

SHUTDOWN FOR AN INK JET PRINTER

TECHNICAL FIELD

The present invention relates to continuous ink jet printing and, more particularly, to an improved shutdown sequence for continuous ink jet printers.

BACKGROUND ART

Current ink jet printing systems consist of a fluid system supporting one or more printheads. Typical ink jet printheads operate by forcing fluid through a droplet generator which contains an array of orifices, forming droplets of ink. The printhead is fully supported by the fluid system, controlling different solenoid valves and pumps to perform necessary functions for the printhead to operate reliably. These functions include cleaning, startup, and shutdown. One particular function, shutdown, provides a means to stop operation of the printhead and fluid system over an extended period of time and allow for returned operation. Ink, or even flushing fluid, if left in the drop generator, can dry in and around the orifices, leaving behind non-volatile components in the form of solids or gels. Upon subsequent startups, the failure to remove or redissolve all of this material in and around the orifices creates disturbances in the shape or direction of the emerging jets.

In the prior art, U.S. Pat. No. 5,463,415, describes the operation of shutting down a printhead of an ink jet printing system. Shutdown typically consists of applying high vacuum to the outlet of a droplet generator with the inlet open to atmosphere through a filtered restriction. The air drawn into the drop generator through the filtered restriction and through the drop generator orifices removes the ink from the interior of the droplet generator. However, longer orifice array lengths and smaller orifices are being required in order to increase printing speeds and improve print quality.

With the changes in the droplet generator, this method of extracting the ink from the droplet generator has been found to be inadequate. In particular, it has been found that the air flow rates through the droplet generator that can be produced in this manner are insufficient to remove significant amounts of ink from the droplet generator.

The fluid system described in U.S. Pat. No. 6,273,103, overcame the air flow limitations of preceding systems by including an air pump to pump air into the inlet of the droplet generator as the system vacuum is extracting ink and air from the droplet generator outlet. This change has been found to greatly enhance ink removal from the droplet generator.

It has been found, however, that even with the increased air flow provided by existing fluid systems, small amounts of ink may still remain in sections of the droplet generator. Such ink, when allowed to dry, can result in a failure during the subsequent startup.

It would be desirable, then, to have a new shutdown procedure to solve the problem of ink and/or flush fluid drying in or around orifice holes on higher resolution printheads.

SUMMARY OF THE INVENTION

This need is met by the improved shutdown technique according to the present invention. The shutdown sequence of the present invention differs from the prior art in that the present invention proposes pulse modulation of air pressure to blow and dry the printhead filters while balancing air flow and negative pressure across the droplet generator and the orifice array.

The present invention dries and removes any type of fluid in the droplet generator and orifice array by pulsing moderately high air flow and pressure to dry the printhead final filters while keeping the droplet generator and orifice array at a negative pressure.

In accordance with one aspect of the present invention, a system and method are provided to improve reliability for shutting down printheads for a continuous ink jet printer. This system and method dries and removes ink residues and other fluids, debris and deposits in the droplet generator and orifice array by pulsing moderately high air flow and pressure to dry the printhead final filters while keeping the droplet generator and orifice array at a negative pressure.

Other objects and advantages of the present invention will be apparent from the following description and the appended claims.

DETAILED DESCRIPTION OF THE INVENTION

In accordance with the present invention, the fluid system of a continuous ink jet printing system may be configured to shutdown one or more printheads with the shutdown sequence of the present invention. Since the separate plumbing within each printhead interface controller (PIC) and printhead is identical, parts of the following description will make reference only to a single printhead, without restricting the invention to a single printhead.

Figure 1:
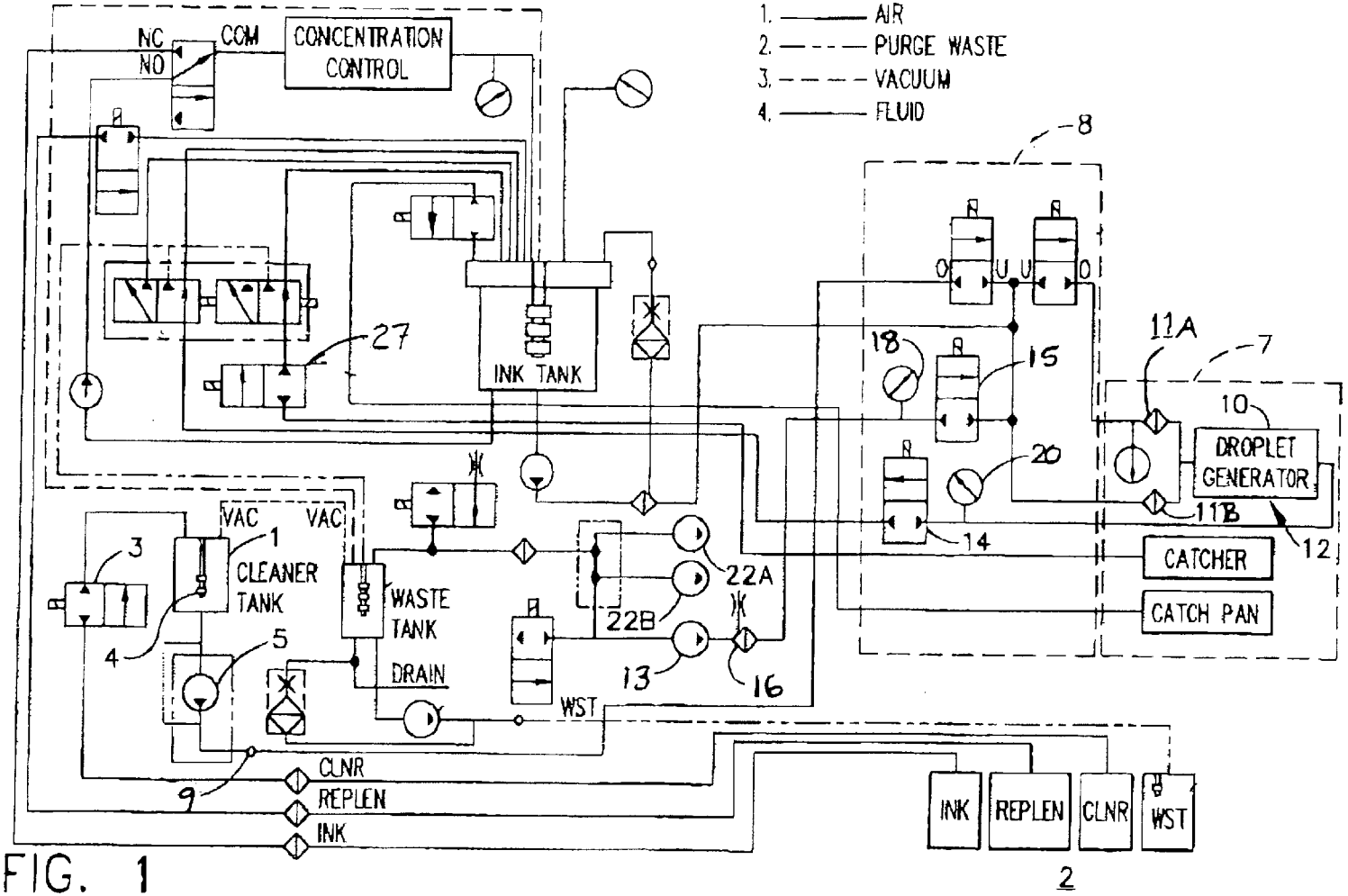
FIG. 1 is an exemplary fluid system schematic for an ink jet printer supporting two printheads with an incorporated flushing system.

Referring now to the drawings, FIG. 1 illustrates an exemplary fluid system schematic for an ink jet printer having an incorporated flushing system. The printhead(s) may be any suitable type, such as for example, nine-inch, 300 dots per inch (dpi) printheads. In FIG. 1, a cleaning fluid supply tank 1 is fed by an external source 2. Fill valve 3 is solenoid actuated, controlled by a float switch 4, maintaining the cleaning fluid level within the supply tank. The air above the supply tank is maintained at a partial vacuum of 10–18 in Hg, providing a pressure gradient for flow.

A pump 5 moves the fluid to the printhead 7 via the PIC manifold 8. The same pump supplies cleaner to multiple printheads in a multiple printhead system, splitting the flow within the pump manifold, not shown. Check valve 9 prevents reverse flow through the pump, as the supply tank 1 is under vacuum.

After the interior of the drop generator and exterior of the orifices and the face of the charge plate and catcher are rinsed with cleaning fluid, air pump 13 is activated to dry the interior of the droplet generator. The air passes through filter 16, such as a 70 micron filter, and a solenoid air valve 15. The air leaves the drop generator through the open bar outlet valve 14, and is exhausted through vacuum pumps 22A and 22B. To sense proper operation of the flushing system, pressure switch 18 and pressure transducer 20 are used to determine air and purge pressures.

Figure 2:
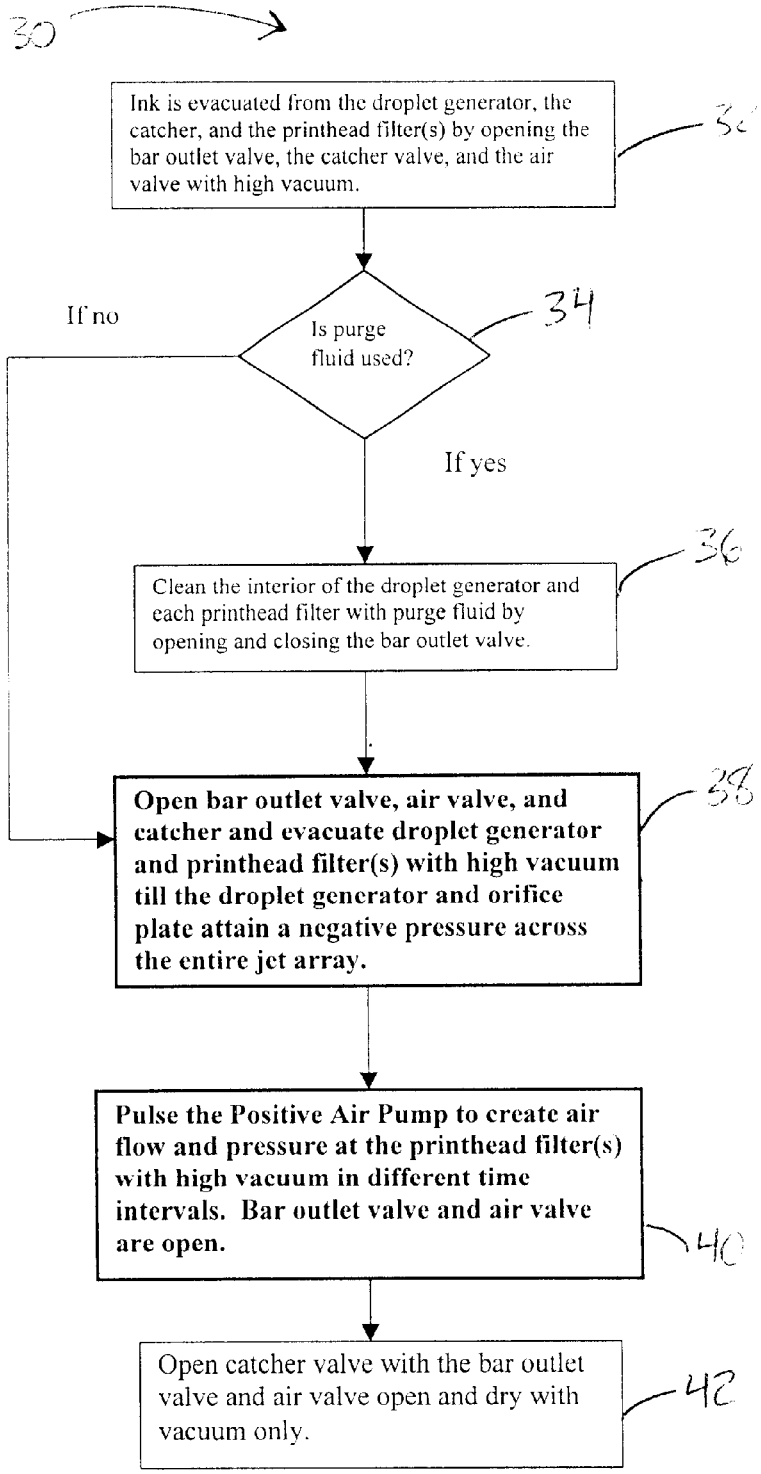
FIG. 2 is a flowchart block diagram of a shutdown process for a continuous ink jet printer, in accordance with the present invention.

A preferred embodiment of the shutdown sequence according to the present invention comprises the steps illustrated in flow chart 30 of FIG. 2. FIG. 2 is a flowchart block diagram illustrating the logic and order of a shutdown process for a continuous ink jet printer, in accordance with the present invention. The shutdown sequence will typically be initiated once the printhead(s) 7 are flushed and cleaned. A suitable flushing and cleaning system and method is that which is described and claimed in U.S. Pat. No. 6,273,103, totally incorporated herein by reference. After the printhead is flushed and cleaned, solenoid valves 14 and 15 open.

Continuing with FIGS. 1 and 2, at step 32, ink is evacuated from the droplet generator and catcher. The air valve is opened and the air pump actuated, providing pressure to blow residual ink out of the air filter. This step conserves ink that would otherwise be diverted to waste as the drop generator is flushed.

If a purge fluid is used, as determined at decision block 34, cleaning of the interior of the droplet generator and each printhead filter with the purge fluid occurs at step 36, by opening and closing the bar outlet valve. Once the purge fluid is used at block 36, or if a purge fluid is not used, as determined at block 34, the sequence continues to block 38. At block 38, the bar outlet valve 14, air valve 15, and catcher valve 27 are opened, and the droplet generator and printhead filter(s) are evacuated with a high vacuum. The high vacuum is continued until the droplet generator and orifice plate attain a negative pressure across the entire jet array.

Once step 38 is complete, the sequence continues to block 40. At block 40, the positive air pump is pulsed to create air flow and pressure at the printhead filter(s) 11*b* at different time intervals. While pulsing the air pump 13, high vacuum is maintained at the droplet generator outlet 52. To achieve higher vacuum levels during this section of the shutdown sequence, the catcher valve 27 is closed. At this step in the sequence, the bar outlet valve and air valve are open. Finally, completing the shutdown sequence, the catcher valve is opened at block 42, along with the bar outlet valve and air valve, and dried with the vacuum only.

In the prior art, after the valves are opened, vacuum pumps 22A and 22B and the air pump 13 are turned on to dry the droplet generator 10 and the orifice plate 12. By using an air pump in combination with the supplied vacuum, the air flow through the droplet generator can be significantly increased. Ink removal from the droplet generator is therefore much more rapid and complete than with earlier systems. It has been found however that small amounts of residual ink could still remain in the droplet generator in spite of the increased air flows.

Figure 3:
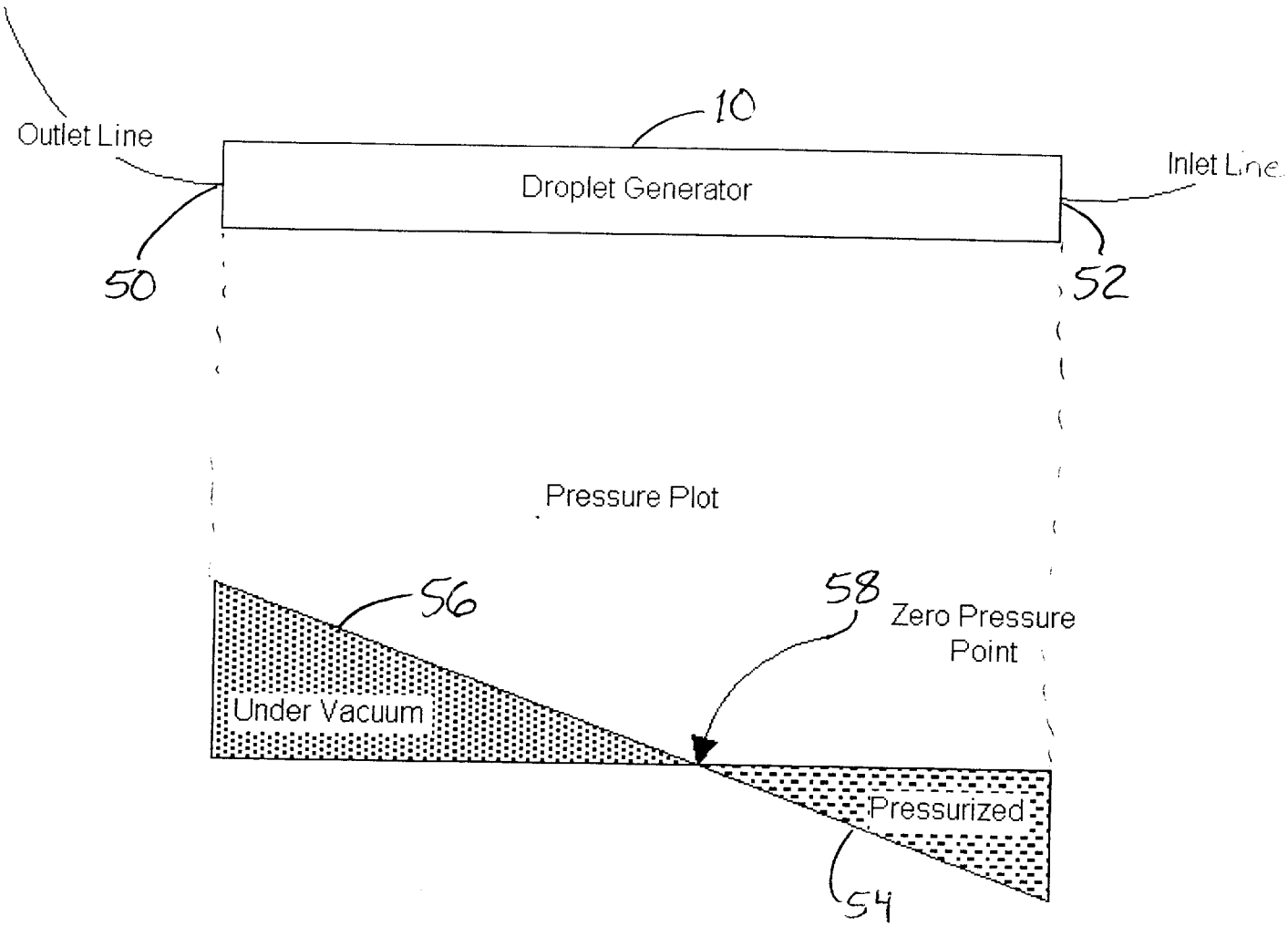
FIG. 3 is a representation of the pressure distribution across the droplet generator with the prior art shutdown method compared to the shutdown sequence of the present invention.

The mechanism by which some residual ink remained in the droplet generator is illustrated in FIG. 3. Supplying vacuum to the outlet 50 from the drop generator 10 and pressurized air produces a pressure gradient across the drop generator. Near the drop generator inlet 52, the pressurized air results in the air and any ink or purge fluid present to be blown out of the orifices, so that the area 54 tends to be pressurized. Nearer the printhead outlet 50, the vacuum causes air to be sucked in through the orifices, removing any ink or purge fluid present in the orifices. Hence, area 56 tends to be under vacuum. In an area 58 in an approximate middle of the orifice array, the air pressure inside the drop generator 10 is the same as the ambient air pressure. Therefore, there is no air flow through the orifices, either inward or outward, to remove fluid from these orifices in area 58, an area of zero pressure. Failure to remove the ink from these orifices can result in ink drying in and plugging them. This is the problem addressed by the present invention, whereby the present invention proposes pulse modulation of air pressure to blow and dry the printhead filters while balancing air flow and negative pressure across the droplet generator and the orifice array.

The shutdown sequence of the present invention addresses the problem of residual ink and/or flush fluid on the orifice plate by supplying constant vacuum to the outlet of the droplet generator while pulsing the air flow supplied to the inlet of the droplet generator to dry the printhead filters and the orifice plate. During the pulses of the supplied air, the high air flow rates are effective in removing the bulk of the ink from the droplet generator. Between the supplied air pulses, the entire droplet generator is maintained under vacuum, eliminating the zero pressure region along the orifice array. In this way, air is drawn in through orifices down the entire length of the orifice array. This air flow forces the ink out of the orifices along the entire length of the orifice array up into the body of the droplet generator. Once into the body of the droplet generator, the ink can be readily removed from there during the subsequent pulses from the air pump.

The drying of the droplet generator 10 and orifice plate 12 begins with solenoid valves 14 and 15 opening. Vacuum pumps 22A and 22B are then increased in speed until an acceptable negative pressure is attained at the pressure transducer 20. The air pump 13 is pulsed on and off in small, incremental time intervals to dry the filter media 11*a* while at the same time assisting the vacuum pumps in drying the orifice plate. The pulsing of the air pump allows the vacuum on the droplet generator to pull any residual fluid off of the orifice plate. This prevents fluid from drying on the orifice plate and returning the jet array to its original condition before it was shutdown.

The time intervals to pulse the air pump on and off could change over time depending on the filter media, jet array length, and orifice size. The shutdown sequence of the present invention could also be used in conjunction with a cleaning and flushing system to clean and dry a printhead in order to use it with different inks. In such an application, both printhead filters 11A and 11B would be subject to the pressure pulses from the air pump.

The air pump is cycled while the vacuum pump is fully on (open loop). All PIC valves except for the air valve are closed. The air valve is open during the pulsing.

| State # | Pump | Time |
|---|---|---|
| <20 | Off | |
| 20 | On | 3 sec |
| 21 | Off | 10 sec |
| 22 | On | 3 sec |
| 23 | Off | 50 sec |
| 24 | 35000 | 1 sec |
| 25 | 45000 | 1 sec |
| 26 | 55000 | 1 sec |
| 27 | On | 5 sec |
| 28 | Off | 15 sec |
| 29 | On | 10 sec |
| 30 | Off | 20 sec |
| 31 | On | 20 sec |
| 32 | Off | 30 sec |
| 33 | On | 20 sec |
| 34 | Off | 30 sec |
| 35 | On | 20 sec |
| 36 | Off | 30 sec |
| 37 | On | 20 sec |

-continued

| State # | Pump | Time |
|---|---|---|
| 38 | Off | 30 sec |
| 39 | On | 40 sec |
| 40 | Off | 60 sec |
| 41 | On | 120 sec |
| >41 | Off | |

Where the pump level is given numerically, that pump level is out of a 65535 level scale. When the pump value is simply marked as On, the pump is operated at full speed, corresponding to level 65535.

In the prior art, from state 27 to 41, the air pump was on continuously. With the present invention, the air pump is pulsed in different time intervals and at different speeds effectively removing the bulk of the ink from the droplet generator and avoiding leaving ink at zero pressure regions of the array.

In an alternative embodiment, clean, pressurized air is supplied to the inlet of the droplet generator, and vacuum is supplied to the outlet of the droplet generator. Rather than pulse the supplied air, the vacuum supplied to the outlet of the droplet generator is pulsed. This might be done by opening and closing the outlet valve 14 shown in FIG. 1. In this embodiment, again, the bulk of the ink is removed from the droplet generator by the combined action of the supplied pressurized air and the supplied vacuum. Between vacuum pulses, the entire droplet generator is pressurized by the supplied air, eliminating the zero pressure region along the orifice array. Any residual ink near the orifices will then be blown out of the orifices. With the printhead eyelid sealed and vacuum supplied to the catcher of the printhead, the small amount of ink blown out of the orifices does not have any adverse effect on subsequent startups.

INDUSTRIAL APPLICABILITY AND ADVANTAGES

The present invention is useful in the shutdown of printheads in an ink jet printing system, particularly for high resolution printheads. The method and system of the present invention have the advantage of improving reliability for shutting down printheads for a continuous ink jet printer. It is a further advantage of the present invention that any type of fluid in the droplet generator and orifice array is dried and removed by pulsing moderately high air flow and pressure to dry the printhead final filters while keeping the droplet generator and orifice array at a negative pressure.

The invention has been described in detail with particular reference to certain preferred embodiments thereof, but it will be understood that modifications and variations can be effected within the spirit and scope of the invention.

What is claimed is:

1. A method for shutting down printheads of a continuous ink jet printing system having a droplet generator with an inlet and an outlet, an associated orifice plate, a jet array, a charge plate, and a catcher, the method comprising the steps of:

providing means to supply vacuum to the outlet of the droplet generator to remove ink from the droplet generator;

providing means to supply clean, pressurized air to the inlet of the droplet generator to assist in removal of ink from the droplet generator; and pulsing at least one of the supply means to supply vacuum or supply pressurized air such that when both supply means are active, resultant high air flow rate through the droplet generator removes fluid from the droplet generator, and when one of the supply means is inactive, a zero pressure region along the orifice array is eliminated.

2. A method as claimed in claim 1 wherein the step of pulsing at least one of the supply means comprises the step of pulsing the means to supply clean, pressurized air while providing a constant supply of vacuum to the outlet of the droplet generator.

3. A method as claimed in claim 1 wherein the step of providing means to supply clean, pressurized air comprises the step of pulsing an air supply pump.

4. A method as claimed in claim 1 wherein the step of providing means to supply clean, pressurized air further comprises the step of providing valve means to stop flow of air to the inlet of the droplet generator.

5. A method as claimed in claim 1 wherein the step of pulsing at least one of the supply means comprises the step of pulsing the means to supply vacuum while providing a constant supply of clean pressurized air to the inlet of the droplet generator.

6. A method as claimed in claim 1 wherein the step of providing means to supply vacuum to the outlet of the droplet generator further comprises the step of pulsing a vacuum pump.

7. A method as claimed in claim 1 wherein the step of providing means to supply vacuum further comprises the step of providing valve means to isolate the outlet of the droplet generator from the vacuum.

8. A method as claimed in claim 1 wherein the step of pulsing further comprises the step of substantially drying and removing fluid from the droplet generator and the jet array.

9. A system for shutting down printheads of a continuous ink jet printing system having a droplet generator with an inlet and an outlet, an associated orifice plate, a jet array, a charge plate, and a catcher, the system comprising:

means to supply vacuum to the outlet of the droplet generator to remove ink from the droplet generator;

means to supply clean, pressurized air to the inlet of the droplet generator to assist in removal of ink from the droplet generator; and means for pulsing at least one of the supply means to supply vacuum or supply pressurized air such that when both supply means are active, resultant high air flow rate through the droplet generator removes fluid from the droplet generator, and when one of the supply means is inactive, a zero pressure region along the orifice array is eliminated.

10. A system as claimed in claim 9 wherein the means for pulsing at least one of the supply means comprises the means for pulsing clean, pressurized air while providing a constant supply of vacuum to the outlet of the droplet generator.

11. A system as claimed in claim 9 wherein the means to supply clean, pressurized air comprises an air supply pump.

12. A system as claimed in claim 11 wherein the air supply pump is pulsed.

13. A system as claimed in claim 9 wherein the means to supply clean, pressurized air further comprises valve means to stop flow of air to the inlet of the droplet generator.

14. A system as claimed in claim 9 wherein the means for pulsing at least one of the supply means comprises the means for pulsing the vacuum supply while providing a constant supply of clean pressurized air to the inlet of the droplet generator.

15. A system as claimed in claim 9 wherein the means to supply vacuum comprises a vacuum pump.

16. A system as claimed in claim 15 wherein the vacuum pump is pulsed.

17. A system as claimed in claim 9 wherein the means to supply vacuum further comprises valve means to isolate the outlet of the droplet generator from the vacuum.

18. A system as claimed in claim 9 wherein the means for pulsing further comprises means for substantially drying and removing fluid from the droplet generator and the jet array.

* * * * *